US008392194B2

(12) United States Patent
Agarwal

(10) Patent No.: US 8,392,194 B2
(45) Date of Patent: Mar. 5, 2013

(54) SYSTEM AND METHOD FOR MACHINE-BASED DETERMINATION OF SPEECH INTELLIGIBILITY IN AN AIRCRAFT DURING FLIGHT OPERATIONS

(75) Inventor: Naval Kishore Agarwal, Sammamish, WA (US)

(73) Assignee: The Boeing Company, Chicago, IL (US)

( * ) Notice: Subject to any disclaimer, the term of this patent is extended or adjusted under 35 U.S.C. 154(b) by 1176 days.

(21) Appl. No.: 12/251,715

(22) Filed: Oct. 15, 2008

(65) Prior Publication Data

US 2010/0094624 A1 Apr. 15, 2010

(51) Int. Cl.
*G10L 21/00* (2006.01)

(52) U.S. Cl. ..... 704/270; 704/233; 704/258; 704/260; 375/243; 348/14.01; 348/14.12; 348/14.13; 381/94.3; 381/94.1

(58) Field of Classification Search ..... 704/260, 704/258, 208, 205, 230, 233, 226–228, 268, 704/206, 222, 245, 267, 223, 270, 225, 254, 704/202; 381/94.3, 317, 92, 94.1; 348/14.01, 348/14.12, 14.13; 382/118; 375/243
See application file for complete search history.

(56) References Cited

U.S. PATENT DOCUMENTS 5,208,860 A * 5/1993 Lowe et al. ..... 381/17
5,333,200 A * 7/1994 Cooper et al. ..... 381/1
5,355,416 A * 10/1994 Sacks ..... 381/17
5,438,623 A * 8/1995 Begault ..... 381/17
5,734,724 A * 3/1998 Kinoshita et al. ..... 381/17
5,825,897 A * 10/1998 Andrea et al. ..... 381/71.6
5,905,464 A * 5/1999 Lanciaux ..... 342/443
6,011,851 A * 1/2000 Connor et al. ..... 381/17
6,061,456 A * 5/2000 Andrea et al. ..... 381/71.6
6,111,958 A * 8/2000 Maher ..... 381/17
7,260,231 B1 * 8/2007 Wedge ..... 381/310
2007/0019824 A1 * 1/2007 Osmanovic et al. ..... 381/93
2008/0130924 A1 * 6/2008 Vaudrey et al. ..... 381/311

OTHER PUBLICATIONS

"Ergonomic Assessment of Speech Communication"; British Standards Institution, Implementation of ISO 9921-1:1996.
"Method for Measuring the Intelligibility of Speech Over Communication Systems"; Acoustical Society of America; Notice of Adoption of ANSI Standard S3.2-1989; May 27, 1993.
Steeneken, H.J.M. and Hougast, T.; "A Physical Method for Measuring Speech-Transmission Quality"; Journal of the Acoustical Society of America; Jan. 1980.
Anderson, B. Wayne and Kalb, Joel T.; "English Verification of the STI Method for Estimating Speech Intelligibility of a Communications Channel"; Journal of the Acoustical Society of America; Jun. 1987.
"Sound System Equipment—Part 16: Objective Rating of Speech Intelligibility by Speech Transmission Index"; International Electrotechnical Commission; International Standard IEC 60268-16, Third Edition May 2003.
Chan, Jeffrey W. and Simpson, Carol A.; "Comparison of Speech Intelligibility i Cockpit Noise Using SPH-4 Flight Helmet With and Without Active Noise Reduction"; NASA Contractor Report 177564 Prepared for Ames Research Center Contract NAS2-13188; Jul. 1990.

* cited by examiner

*Primary Examiner* — Vijay B Chawan
(74) *Attorney, Agent, or Firm* — Armstrong Teasdale LLP

(57) ABSTRACT

A method for effecting a machine-based determination of speech intelligibility in an aircraft during flight operations includes: (a) in no particular order: (1) providing a representation of a machine-based speech evaluating signal; and (2) providing a representation of in-flight noise; (b) combining the representation of a machine-based speech evaluation signal and the representation of in-flight noise to obtain a combined noise signal; and (c) employing the combined noise signal to present the machine-based determination of speech intelligibility in an aircraft during flight operations.

20 Claims, 2 Drawing Sheets

SYSTEM AND METHOD FOR MACHINE-BASED DETERMINATION OF SPEECH INTELLIGIBILITY IN AN AIRCRAFT DURING FLIGHT OPERATIONS

FIELD

The present invention is directed to systems and methods for machine-based determination of speech intelligibility in an aircraft during flight operations, and especially to such systems and methods that do not require dedicated flight time for their employment.

BACKGROUND

There may be an increasing emphasis on speech intelligibility in aircraft, including military aircraft, from a safety and operational standpoint. An aircraft operator's ability to communicate during an emergency may be important. Speech intelligibility in a flight environment may not only include a crew's ability to hear, but may also include the accuracy with which the crew can understand spoken words in the aircraft's noise environment. Generally there are two forms of speech intelligibility measurement: (1) human-based or direct testing and (2) machine-based or indirect testing. With direct testing expert listeners monitor specially constructed speech samples directly or broadcast over a sound system and the listeners may mark the words or sentences they hear on a prepared test sheet. In indirect testing either speech or a special test signal may be broadcast over a sound system, and a received signal may be picked up by a microphone and analyzed to produce a result signal. Degradation components may also be produced. A ratio of useful signal to detrimental signal may be computed.

A human-based testing procedure such as the Modified Rhyme Test (MRT) method may be used to evaluate speech intelligibility in the cabin, flight deck and communication systems in a flight environment. MRT may be regarded as a subjective speech intelligibility metric that not only requires substantial resources in terms of jury training and flight testing costs, but may also require a dedicated test airplane with a capability to accommodate a jury of 10-15 people, comprising of speakers and listeners, for an extended period of time. A machine-based testing procedure that may yield an intelligibility metric that may correlate with speech intelligibility and MRT may be obtained using a machine-based Speech Transmission Index (STI) signal.

STI is a measurement technique for determining speech intelligibility that employs a principle that speech intelligibility is based upon slow modulation of the strength of a carrier sound pressure signal associated with speech. STI considers background noise level, reverberation time and space size using special test signals having a fundamental wave form modulated by low-frequency signals. Depth of modulation of a received signal (after traversing a test space) is compared with the original test signal (broadcast into the test space) in each of a number of frequency bands. Reductions in modulation depth may be associated with loss of intelligibility. Using STI according to prior art techniques may require recording special signals at each measurement location or test space in an aircraft during expensive flight tests requiring a dedicated test airplane operating aloft.

There is a need for a system and method for effecting a machine-based determination of speech intelligibility in an aircraft during flight operations that minimizes or eliminates a need for airborne testing procedures.

SUMMARY

A method for effecting a machine-based determination of speech intelligibility in an aircraft during flight operations includes: (a) in no particular order: (1) providing a representation of a machine-based speech evaluating signal; and (2) providing a representation of in-flight noise; (b) combining the representation of a machine-based speech evaluation signal and the representation of in-flight noise to obtain a combined noise signal; and (c) employing the combined noise signal to present the machine-based determination of speech intelligibility in an aircraft during flight operations.

A system for effecting a machine-based determination of speech intelligibility in an aircraft during flight operations includes: (a) a signal generating unit for storing a representation of a machine-based speech evaluating signal; (b) a presenting unit coupled with the signal generating unit; (c) a ground-based signal receiving unit; the presenting unit cooperating with the signal generating unit to present the machine-based speech evaluating signal to the ground-based signal receiving unit; the ground-based signal receiving unit storing a ground-based machine-based speech evaluating signal; (d) an in-flight based signal receiving unit; the in-flight based signal receiving unit operating to receive and store an in-flight noise representation; and (e) a combining unit coupled with the ground-based signal receiving unit and with the in-flight based signal receiving unit; the combining unit combining the ground-based machine-based speech evaluating signal and the in-flight noise representation to present the machine-based determination of speech intelligibility in an aircraft during flight operations.

A system for effecting a machine-based determination of speech intelligibility in an aircraft during flight operations includes: (a) a ground-based signal storing unit storing a ground-based representation of a machine-based speech evaluating signal; (b) an in-flight based signal storing unit storing an in-flight noise representation; and (c) a combining unit coupled with the ground-based signal storing unit and with the in-flight based signal storing unit; the combining unit combining the ground-based representation of a machine-based speech evaluating signal and the in-flight noise representation to present the machine-based determination of speech intelligibility in an aircraft during flight operations.

It is, therefore, a feature of the present disclosure to provide a system and method for effecting a machine-based determination of speech intelligibility in an aircraft during flight operations that minimizes or eliminates a need for airborne testing procedures.

Further features of the present disclosure will be apparent from the following specification and claims when considered in connection with the accompanying drawings, in which like elements are labeled using like reference numerals in the various figures, illustrating the preferred embodiments of the disclosure.

DETAILED DESCRIPTION

Figure 1:
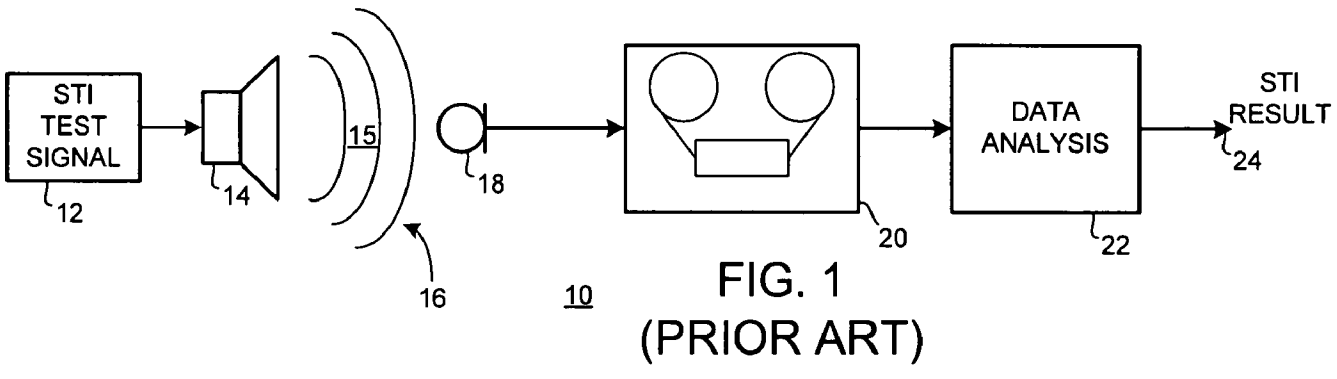
FIG. 1 (PRIOR ART)
FIG. 1 is a schematic diagram of a prior art system for effecting a machine-based determination of speech intelligibility in an aircraft during flight operations.

FIG. 1 is a schematic diagram of a prior art system for effecting a machine-based determination of speech intelligibility in an aircraft during flight operations. In FIG. 1, an in-flight prior art speech intelligibility testing system 10 includes a signal generating unit 12 coupled with an audio speaker unit 14. Signal generating unit 12 may store or may originate a machine-based test signal such as a Speech Transmission Index (STI) signal. Speaker unit 14 may present the STI signal within the ambient noise of a test aircraft space 15 in which speech intelligibility is being evaluated so that a total STI-plus-ambient sound signal (indicated generally at 16) may be received at an audio microphone unit 18. Microphone unit 18 may be coupled with an audio recording unit 20. Recording unit 20 may record audio signals received by microphone unit 18 so that a total STI-plus-ambient sound signal detected or received at microphone unit 18 may be stored on a recording medium by recording unit 20 and passed to a data analysis unit 22. Data analysis unit 22 may evaluate or manipulate data contained in the stored total STI-plus-ambient sound signal to present a resultant STI signal at an output locus 24. The resultant STI signal presented at output locus 24 may indicate intelligibility of sound transmitted in the test aircraft space 15.

Figure 2:
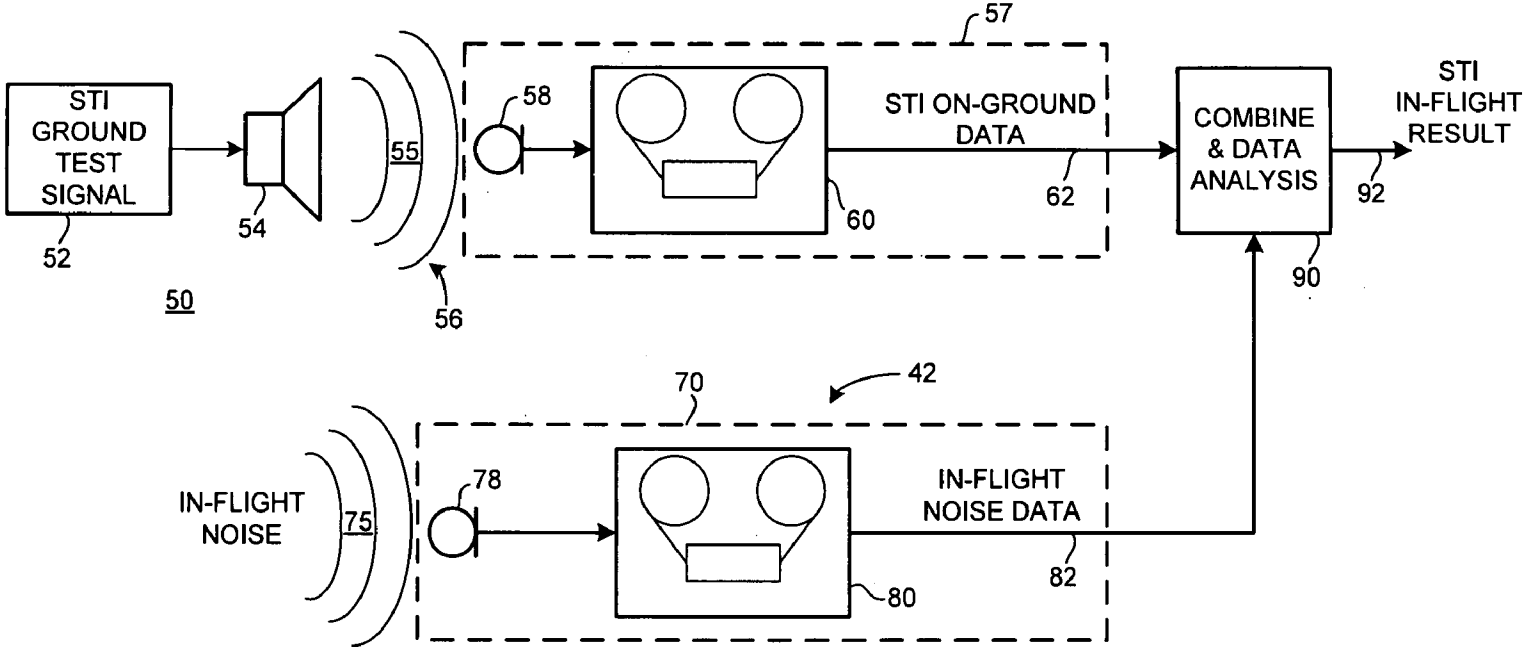
FIG. 2 is a schematic diagram of an exemplary system for effecting a machine-based determination of speech intelligibility in an aircraft during flight operations configured according to the teachings of the present disclosure.

FIG. 2 is a schematic diagram of an exemplary system for effecting a machine-based determination of speech intelligibility in an aircraft during flight operations configured according to the teachings of the present disclosure. As used herein, the term exemplary indicates an example and not necessarily an ideal. In FIG. 2, a speech intelligibility testing system 50 may include a ground-based sub-system 40 and a flight-based sub-system 42. Ground-based sub-system 40 may include a signal generating unit 52 coupled with a signal presenting unit 54. Signal generating unit 52 may store or may originate a machine-based test signal such as a Speech Transmission Index (STI) signal. Signal presenting unit 54 may present the STI signal within the ambient noise of a ground-based test space 55 so that a representation of the STI signal (indicated generally at 56) may be received at a ground-based receiving unit 57. Ground test space 55 may be a noise-free space. Ground-based receiving unit 57 may include a signal receiving unit 58 and a signal recording unit 60. Signal presenting unit 54 and signal receiving unit 58 may cooperate to convey the machine-based test signal through ground-based test space 55. An embodiment of signal presenting unit 54 may be an audio speaker unit. An embodiment of signal receiving unit 58 may be an audio microphone unit.

Signal receiving unit 58 may be coupled with signal recording unit 60. Signal recording unit 60 may record test signals received by signal receiving unit 58 so that a test signal detected or received at signal receiving unit 58 may be stored on a recording medium by signal recording unit 60. Signals stored by signal recording unit 60 may be presented at an output locus 62 as STI on-ground signals or data.

Flight-based sub-system 42 may include a flight-based receiving unit 70. Flight-based receiving unit 70 may include a signal receiving unit 78 and a signal recording unit 80. Signal receiving unit 78 may be located or situated for sensing or receiving ambient sound signals in an aircraft test space 75 while engaged in flight operations. An embodiment of signal receiving unit 78 may be an audio microphone unit.

Signal receiving unit 78 may be coupled with signal recording unit 80. Signal recording unit 80 may record signals received by signal receiving unit 78 so that a signal detected or received at signal receiving unit 78 may be stored on a recording medium by signal recording unit 80. Signals stored by signal recording unit 80 may be presented at an output locus 82 as in-flight noise data.

A combining unit 90 may be coupled with output loci 62, 82. Combining unit 90 may combine STI On-Ground Data received from output locus 62 with In-Flight Noise Data received from output locus 82 and may analyze or evaluate the combined data to present an STI-In-Flight Result at an output locus 92. The STI-In-Flight Result presented at output locus 92 may indicate intelligibility of sound transmitted in aircraft test space 75 while engaged in flight operations.

Figure 3:
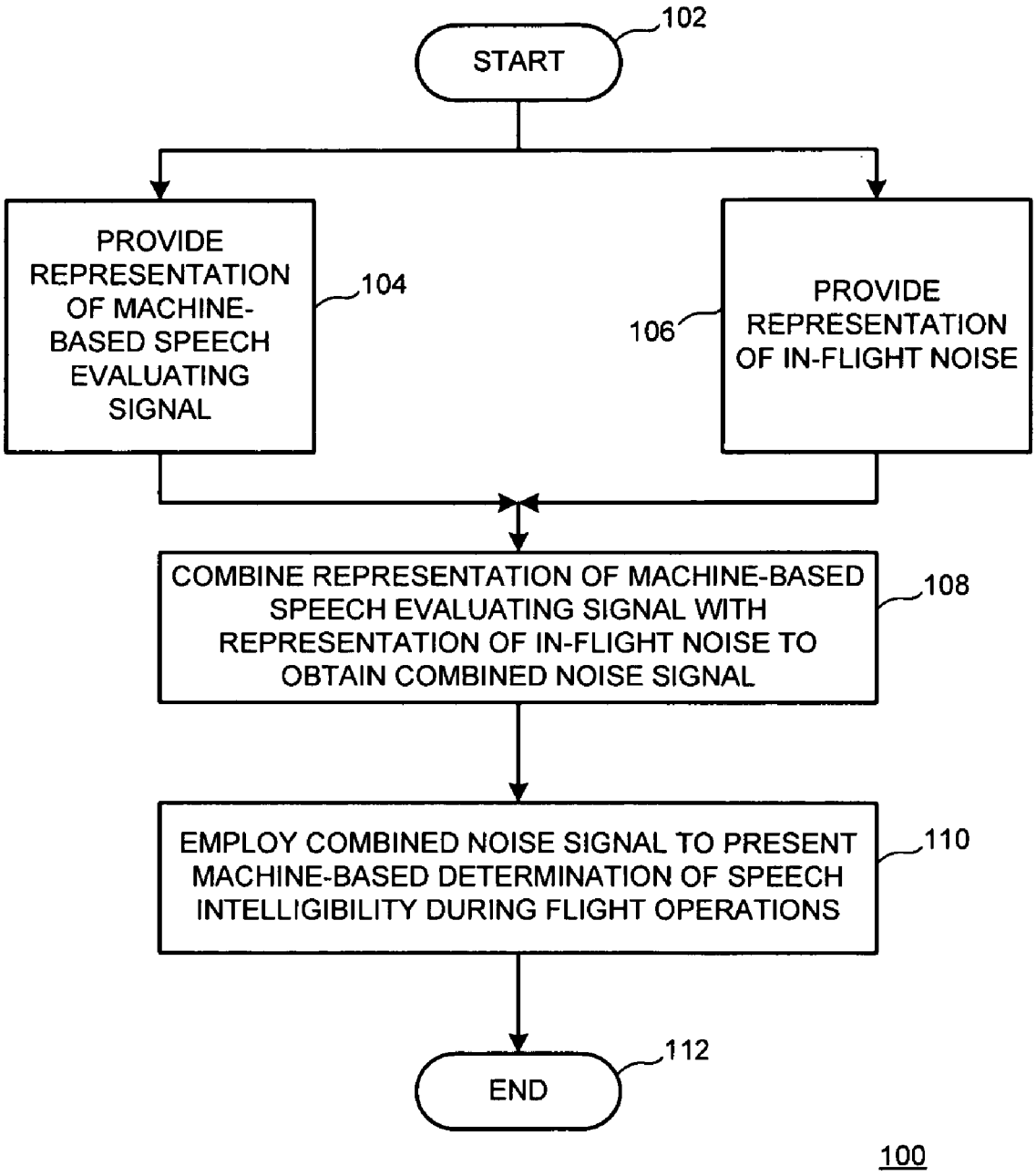
FIG. 3 is a flow chart illustrating the method for effecting a machine-based determination of speech intelligibility in an aircraft during flight operations configured according to the teachings of the present disclosure.

FIG. 3 is a flow chart illustrating the method for effecting a machine-based determination of speech intelligibility in an aircraft during flight operations configured according to the teachings of the present disclosure. In FIG. 3, a method 100 for effecting a machine-based determination of speech intelligibility in an aircraft during flight operations may begin at a START locus 102. Method 100 may continue with, in no particular order: (1) providing a representation of a machine-based speech evaluating signal, as indicated by a block 104; and (2) providing a representation of in-flight noise, as indicated by a block 106. The representation of a machine-based speech evaluating signal may be a speech transmission index signal, speech, or other special test signal. In addition, the machine-based speech evaluating signal may be configured to indicate speech intelligibility by at least one signal parameter. For example, without limitation, a parameter may include signal level, modulation depth, reverberation, or frequency. The representation of in-flight noise may be a recording of in-flight noise, an aircraft-specific recording of in-flight aircraft noise, or a simulated in-flight noise signal.

Method 100 may continue with combining the representation of a machine-based speech evaluation signal and the representation of in-flight noise to obtain a combined noise signal, as indicated by a block 108. Method 100 may continue with employing the combined noise signal to present the machine-based determination of speech intelligibility in an aircraft during flight operations, as indicated by a block 110. Method 100 may terminate at an END locus 112.

A machine-based test signal may be recorded on-ground. Aircraft flight noise may be recorded while aloft. Aircraft flight noise recording may be effected in conjunction with other operations so that little or no flight time must be dedicated solely to a noise recording operation. The system and method of the present disclosure may permit combining the ground-based machine test signal with the aloft-recorded flight noise to permit effecting a machine-based determination of speech intelligibility in an aircraft during flight operations that minimizes or eliminates a need for airborne testing procedures.

It is to be understood that, while the detailed drawings and specific examples given describe preferred embodiments of the disclosure, they are for the purpose of illustration only, that the apparatus and method of the disclosure are not limited to the precise details and conditions disclosed and that various changes may be made therein without departing from the spirit of the disclosure which is defined by the following claims:

I claim:

1. A method for effecting a machine-based determination of speech intelligibility in an aircraft during flight operations, the method comprising:

(a) in no particular order:

(1) providing a representation of a machine-based speech evaluating signal at a ground-based sub-system; and (2) providing a representation of in-flight noise at a flight-based subsystem;

(b) combining said representation of a machine-based speech evaluation signal from said ground-based subsystem and said representation of in-flight noise from said flight-based subsystem to obtain a combined noise signal; and (c) employing said combined noise signal to present said machine-based determination of speech intelligibility in an aircraft during flight operations.

2. A method for effecting a machine-based determination of speech intelligibility in an aircraft during flight operations as recited in claim 1 wherein said machine-based speech evaluating signal is configured for indicating speech intelligibility by at least one signal parameter.

3. A method for effecting a machine-based determination of speech intelligibility in an aircraft during flight operations as recited in claim 1 wherein said representation of in-flight noise is a recording of in-flight noise.

4. A method for effecting a machine-based determination of speech intelligibility in an aircraft during flight operations as recited in claim 3 wherein said recording of in-flight noise is an aircraft-specific recording of aircraft noise.

5. A method for effecting a machine-based determination of speech intelligibility in an aircraft during flight operations as recited in claim 1 wherein said machine-based speech evaluating signal is a speech transmission index signal.

6. A method for effecting a machine-based determination of speech intelligibility in an aircraft during flight operations as recited in claim 5 wherein said representation of in-flight noise is a recording of in-flight noise.

7. A method for effecting a machine-based determination of speech intelligibility in an aircraft during flight operations as recited in claim 6 wherein said recording of in-flight noise is an aircraft-specific recording of aircraft noise.

8. A system for effecting a machine-based determination of speech intelligibility in an aircraft during flight operations, the system comprising:

(a) a signal generating unit for storing a representation of a machine-based speech evaluating signal;

(b) a presenting unit coupled with said signal generating unit;

(c) a ground-based signal receiving unit, said presenting unit cooperating with said signal generating unit to present said machine-based speech evaluating signal to said ground-based signal receiving unit, said ground-based signal receiving unit storing a ground-based machine-based speech evaluating signal;

(d) an in-flight based signal receiving unit, said in-flight based signal receiving unit operating to receive and store an in-flight noise representation; and (e) a combining unit coupled with said ground-based signal receiving unit and with said in-flight based signal receiving unit, said combining unit combining said ground-based machine-based speech evaluating signal and said in-flight noise representation to present said machine-based determination of speech intelligibility in an aircraft during flight operations.

9. A system for effecting a machine-based determination of speech intelligibility in an aircraft during flight operations as recited in claim 8 wherein said machine-based speech evaluating signal is configured for indicating speech intelligibility by at least one signal parameter.

10. A system for effecting a machine-based determination of speech intelligibility in an aircraft during flight operations as recited in claim 8 wherein said representation of in-flight noise is a recording of in-flight noise.

11. A system for effecting a machine-based determination of speech intelligibility in an aircraft during flight operations as recited in claim 10 wherein said recording of in-flight noise is an aircraft-specific recording of aircraft noise.

12. A system for effecting a machine-based determination of speech intelligibility in an aircraft during flight operations as recited in claim 8 wherein said machine-based speech evaluating signal is a speech transmission index signal.

13. A system for effecting a machine-based determination of speech intelligibility in an aircraft during flight operations as recited in claim 12 wherein said representation of in-flight noise is a recording of in-flight noise.

14. A system for effecting a machine-based determination of speech intelligibility in an aircraft during flight operations as recited in claim 13 wherein said recording of in-flight noise is an aircraft-specific recording of aircraft noise.

15. A system for effecting a machine-based determination of speech intelligibility in an aircraft during flight operations, the system comprising:

(a) a ground-based signal storing unit storing a ground-based representation of a machine-based speech evaluating signal;

(b) an in-flight based signal storing unit storing an in-flight noise representation; and (c) a combining unit coupled with said ground-based signal storing unit and with said in-flight based signal storing unit, said combining unit combining said ground-based representation of a machine-based speech evaluating signal and said in-flight noise representation to present said machine-based determination of speech intelligibility in an aircraft during flight operations.

16. A system for effecting a machine-based determination of speech intelligibility in an aircraft during flight operations as recited in claim 15 wherein said machine-based speech evaluating signal is configured for indicating speech intelligibility by at least one signal parameter.

17. A system for effecting a machine-based determination of speech intelligibility in an aircraft during flight operations as recited in claim 15 wherein said representation of in-flight noise is a recording of in-flight noise.

18. A system for effecting a machine-based determination of speech intelligibility in an aircraft during flight operations as recited in claim 17 wherein said recording of in-flight noise is an aircraft-specific recording of aircraft noise.

19. A system for effecting a machine-based determination of speech intelligibility in an aircraft during flight operations as recited in claim 15 wherein said machine-based speech evaluating signal is a speech transmission index signal.

20. A system for effecting a machine-based determination of speech intelligibility in an aircraft during flight operations as recited in claim 19 wherein said representation of in-flight noise is a recording of in-flight noise.

* * * * *